United States Patent [19]

Perevuznik et al.

[11] Patent Number: 4,883,413

[45] Date of Patent: Nov. 28, 1989

[54] ROTARY SPIRAL PISTON DISPLACEMENT MACHINE HAVING A SILICON RUBBER BIASED SEAL

[75] Inventors: Josef Perevuznik, Fislisbach; Fritz Spinnler, Arisdorf; Jürg Weber, Birmenstorf, all of Switzerland

[73] Assignee: BBC Brown Boveri AG, Baden, Switzerland

[21] Appl. No.: 214,340

[22] Filed: Jul. 1, 1988

[30] Foreign Application Priority Data

Jul. 10, 1987 [CH] Switzerland ..... 2638/87

[51] Int. Cl.[4] ..... F04C 18/04; F04C 27/00; F16F 1/36; F16J 15/48

[52] U.S. Cl. ..... 418/55; 418/142; 267/153; 277/34.3; 277/164; 277/204

[58] Field of Search ..... 418/55, 142; 277/34, 277/34.3, 164, 204, 226; 267/1.5, 153

[56] References Cited

U.S. PATENT DOCUMENTS

| | | | |
|---|---|---|---|
| 2,832,618 | 4/1958 | Knoll et al. | 277/34 |
| 3,226,126 | 12/1965 | Plate | 277/226 |
| 3,464,707 | 9/1969 | Packard et al. | 277/164 |
| 3,994,636 | 11/1976 | McCullough et al. | 418/55 |
| 4,082,484 | 6/1983 | McCullough | 418/55 |
| 4,192,152 | 3/1980 | Armstrong et al. | 418/55 |
| 4,564,343 | 1/1986 | Nakamura et al. | 418/142 |

FOREIGN PATENT DOCUMENTS

| | | | |
|---|---|---|---|
| 0124114 | 11/1984 | European Pat. Off. . | |
| 2753336 | 5/1979 | Fed. Rep. of Germany | 277/34 |
| 2603462 | 3/1982 | Fed. Rep. of Germany . | |
| 3140512 | 4/1983 | Fed. Rep. of Germany . | |
| 908116 | 10/1962 | United Kingdom . | |

*Primary Examiner*—John J. Vrablik

*Attorney, Agent, or Firm*—Burns, Doane, Swecker & Mathis

[57] ABSTRACT

In a rotary-piston displacement machine, to seal the flat sealing planes between the end faces of the displacement body (5), executing a circular motion, and the side faces (20) of the stationary housing (7) which run parallel thereto, the end faces of the displacement body (5) are provided with a groove (13) in which an elastic sealing strip (14) made of slideable material is inserted. The sealing strip is pressed by a silicone tube (15) against the side wall (20).

3 Claims, 3 Drawing Sheets

ROTARY SPIRAL PISTON DISPLACEMENT MACHINE HAVING A SILICON RUBBER BIASED SEAL

FIELD OF THE INVENTION

The invention relates to a rotary-piston displacement machine for compressible media, comprising at least one delivery space which is defined by spiral-shaped peripheral walls, extending axially from a side wall, and leads from an inlet to an outlet, and comprising a spiral-shaped displacement body which protrudes into the delivery space and is mounted with respect to the latter for executing a circling, torsion-free motion and its center is offset eccentrically relative to the center of the peripheral walls in such a way that the displacement body always touches both the outer and the inner peripheral wall of the delivery space at at least one advancing contact point each, wherein the end faces of the displacement body which adjoin the side wall are provided with a groove in which a sealing strip made of an elastic and slideable material is inserted, and wherein a spring element is arranged between groove root and the underside of the sealing strip.

DISCUSSION OF BACKGROUND

A rotary-piston machine whose principle is disclosed by DE No. 2,603,462 C3 is suitable for supercharging an internal combustion engine, since it is distinguished by a virtually pulsation-free delivery of the working medium, consisting, for example, of air or an air-fuel mixture. During the operation of a supercharging device of this type, a plurality of crescent-shaped working spaces are enclosed along the delivery space between the displacer and the two peripheral walls of the delivery space, which working spaces move from the inlet through the delivery space to the outlet. At the same time, its volume is increasingly reduced with a corresponding increase in the pressure of the working medium. The seal between the working spaces above and below the displacer is of crucial importance here.

U.S. Pat. No. 3,994,636 discloses a displacement machine of the type mentioned at the beginning. In order to achieve an effective radial seal between the end faces of the displacer and the side walls of the delivery space, effective axial contact is to be made between the two elements. For this purpose, the displacer, at its end face, is provided with a groove which is a seat for a sealing strip inserted therein. This sealing strip is made of an elastic, slideable material and is dimensioned in such a way that it can be moved axially and slightly radially inside the groove. A force-exerting spring element, which is a metallic spring band having a U-shaped cross section, is placed underneath.

In small spiral superchargers, however, the configuration of the groove is restricted. If, for example, the displacer only has an overall thickness of 4 mm, the groove width can be 2 mm at most. In this case, the said embodiment has two drawbacks: on the one hand, the spring element, if it is to extend over the entire groove length or sealing length, must be pre-bent mechanically in order to match the spiral-shaped profile of the groove; on the other hand, the spring deflection achievable is exceptionally small, as revealed, incidentally, by FIG. 8 of the said publication; on account of the spring characteristic, this has an unfavorable effect on the constancy of the contact pressure.

From the same publication it is known to achieve greater spring displacements by the use of helical springs, of which a certain number sit in corresponding bores in the groove in such a way as to be distributed uniformly over the sealing length (FIGS. 5, 6 of U.S. Pat. No. 3,994,636). However, this solution makes the manufacture of the displacer more expensive and complicates, not insignificantly, the assembly of the supercharger device.

It is also known from the same U.S. Pat. No. 3,994,636 to use rubber cords as spring-elastic means. However, round cords of this type have the disadvantage that they have a relatively flat spring characteristic, ie. they are relatively rigid. They are able to compensate for the tolerances occurring during production and assembly of the machine only to a limited degree. In addition, they tend to change spring properties or even completely lose them as a result of setting phenomena occurring during the operating period.

SUMMARY OF THE INVENTION

Accordingly, one object of this invention is to provide a novel non-rigid spring element in a rotary-piston displacement machine of the type mentioned at the beginning, which non-rigid spring element, in addition, permits simple handling, and, with the spring force of which, reliable sealing of the working spaces, which is satisfactory for prolonged operating periods, is guaranteed.

According to the invention, this is achieved when the spring element is a tube of silicone rubber.

The advantage of the invention can be seen in particular from the fact that the spring element, which is simple to manufacture, can follow in the intended bending plane any radius of curvature in a manner free of torsion, and that is also readily withstands temperatures up to 150° C.

An embodiment in which the tube end on the inlet side is closed while its end on the outlet side is open has been found to be especially convenient. The inside of the tube is thus acted upon by the respective supercharge pressure. During partial load, in particular the contact pressure of the sealing strip on the corresponding wall and therefore the friction loss too are thus reduced. A solution of this type has in fact already been disclosed in principle by DE No. 3,140,512 A1. In this prior art, a design of the sealing strips with a rear channel which can be pressurized proved to be especially advantageous. In a form which is simple to realize, the sealing strips have the form of rectangular sealing bands which are incorporated in a channel which is of suitable width but in depth keeps a rear channel space clear. This rear channel space can be connected to the pressure side of the displacement machine and is intended to provide uniform pressurising of the sealing bands from the rear and thus a uniform contact of the sealing bands even in the face of advancing wear. However, it cannot be denied that in this solution the sealing strips must also be invery close contact laterally so that the pressure does not escape from the rear space into the working space.

BRIEF DESCRIPTION OF THE DRAWINGS

A more complete appreciation of the invention and many of the attendant advantages thereof will be readily obtained as the same becomes better understood by reference to the following detailed description when considered in conection with the accompanying drawings, wherein.

Figure 1:
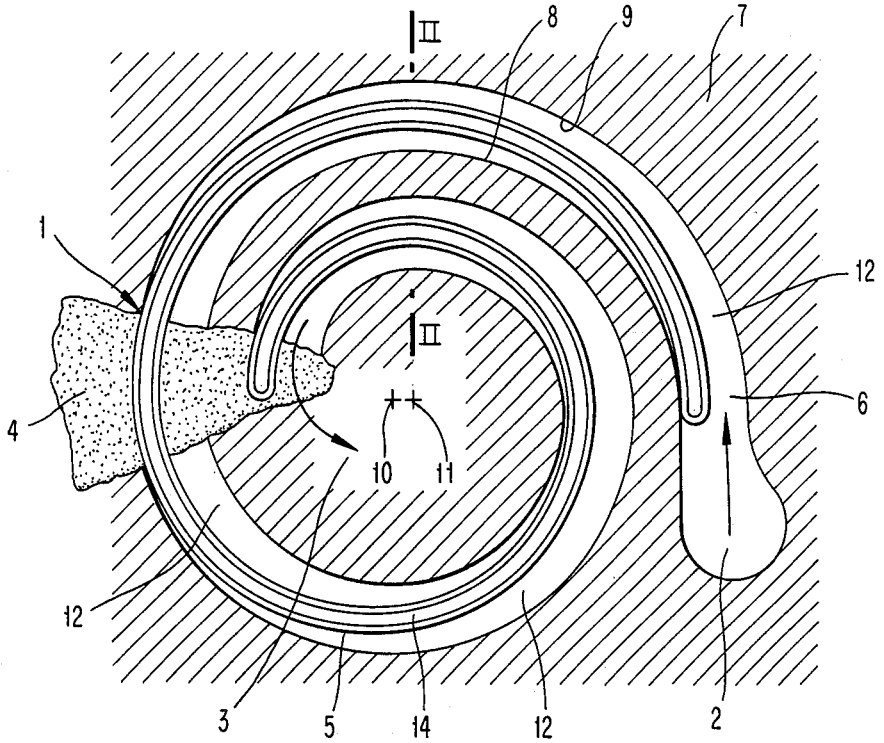
FIG. 1 shows a cross section through the rotary-piston compressor with an end face elevation of the displacement body.

All parts which are not essential for understanding the invention, such as, for example, the drive, the bearing arrangement and the guidance of the rotor, the inflow and outflow of the working medium, have been omitted in the drawing.

DESCRIPTION OF THE PREFERRED EMBODIMENTS

Referring now to the drawings, wherein like reference numerals designate identical or corresponding parts throughout the several views, in the FIGURES the machine shown, for simplicity, is depicted with only one delivery chamber 6 and only one displacer 1. It goes without saying, however, that the displacer can have a complete system of spirals in the same plane, each of which, for example, can delivery from a separate inlet 2 into a common outlet 3.

For the purpose of explaining the mode of operation of the compressor, which is not the subject-matter of the invention reference is made to the said DE No. 2,603,462 C3. Only the machine construction and the process sequence necessary for understanding the invention are described briefly below.

The disk-shaped displacer is designated overall by 1. Displacement bodies 5 running in a spiral shape are arranged on both sides of the disk 4. These displacement bodies 5 engage into a delivery space 6 of the stationary housing 7. The delivery space 6 is made, for example, in the housing 7 in the manner of a spiral-shaped slot. It runs from an inlet 2, arranged in the housing at the outer periphery of the spiral, to an outlet 3 arranged inside the housing. It has substantially parallel peripheral walls 8, 9 which are arranged at a uniform distance from one another and, like the displacement body, enclose a spiral of more than 360°. The displacement body 5 is held between these peripheral walls 8, 9. Its curvature is dimensioned in such a way that it touches the inner and outer peripheral walls at a plurality of locations. For this purpose, the center 10 of the displacement body 5 is eccentrically offset relative to the center 11 of the delivery space 6.

At a result of the eccentric drive of the disk-shaped rotor having the displacement body 5, a circular motion is established at every point of the displacement body during the operation of the machine, this circular motion being defined by the peripheral walls of the delivery chamber. As a result of the repeated, alternating approach of the displacement body to the inner and outer peripheral walls, crescent-shaped working spaces 12 enclosing the working medium arise on both sides of the displacement body, which working spaces 12 are displaced by the eccentric drive of the displacement body through the delivery space towards the outlet. The volume of these working spaces is at the same time reduced and the pressure of the working medium increases accordingly.

To seal the flat sealing planes between the end faces of the displacement body 5 and the side faces 20 of the delivery space 6 which run parallel thereto, the displacement bodies are now provided at the end faces with an encircling groove 13 in which an elastic sealing strip 14 made of a slideable material is inserted.

Figure 2:
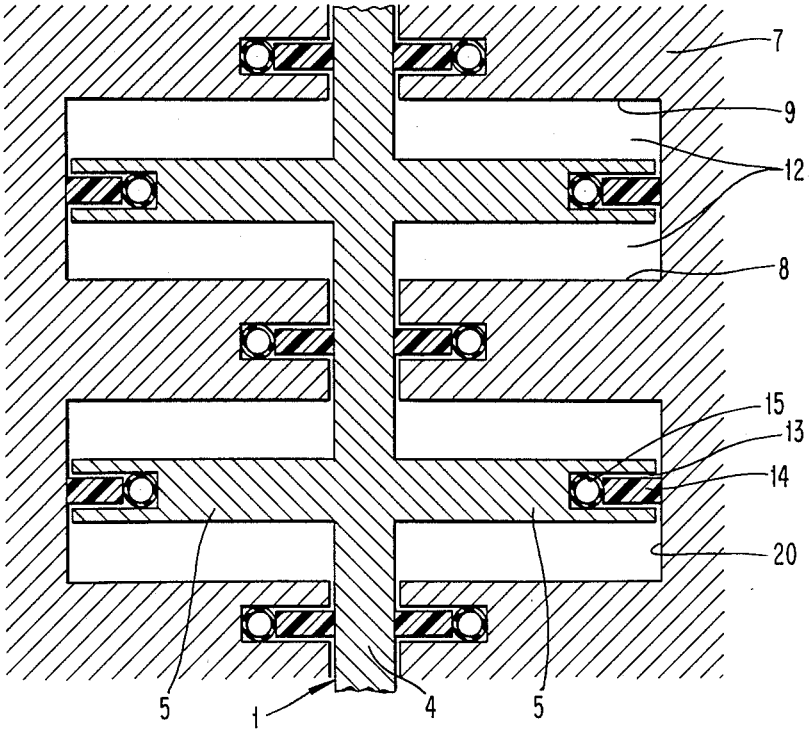
FIG. 2 shows a slightly enlarged partial section through the plane A—A in FIG. 1.

It can be recognized from FIG. 2 that this groove 13 has a rectangular shape and accommodates the likewise rectangular sealing strip 14. As an example of an actual embodiment, the cross section of the sealing strip is about 1.8×2.3 mm at a groove width of about 2 mm. When the walls are parallel, both axial (outwards) and slightly radial displaceability of the sealing strip is thereby ensured.

If the sealing strip, during normal operation, is to protrude about 0.4 mm beyond the edge of the end face, the corresponding groove depth results from the sealing strip height remaining in the groove plus the space required for the force-exerting spring element.

Figure 3:
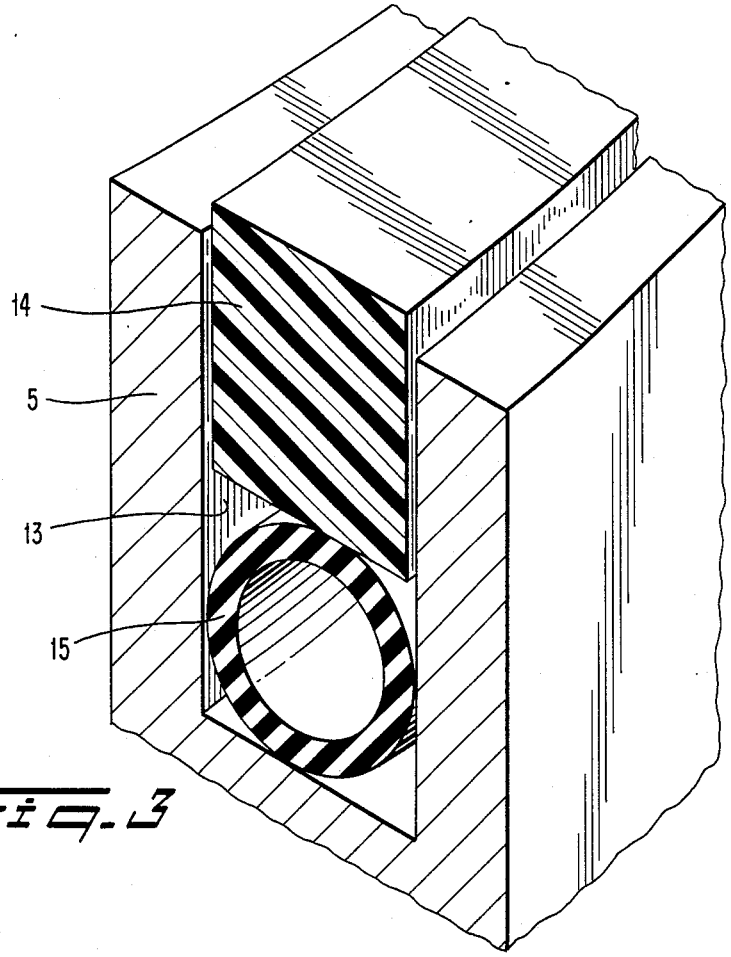
FIG. 3 shows a section in perspective through a sealing arrangement.

FIG. 3 shows the configuration of this spring element 15 and its arrangement in the groove.

This is a thin tube of silicone rubber as is used, for example, throughout the medical field. In the present case its outside diameter is 2 mm.

Of particular advantage is the property that the tube can effortlessly follow any curvature.

Furthermore, on account of its all-round contact, slipping of the tube in the longitudinal direction of the groove is impossible.

It is not difficult to recognise that, at a given overall spring height, which basically corresponds to the outside diameter of the tube, with the selection of the wall thickness a simple means is available for setting the spring force required. However, it should be noted that in principle no deformation and thus no change in the spring loading occurs during operation. Nonetheless, the spring according to the invention is especially effective even in the face of considerable wear of the sealing strip 14, since—starting from the compressed state, in which it has a height of twice the wall thickness—it is able to relax up to the full diameter at an approximately uniform spring force.

Figure 5:
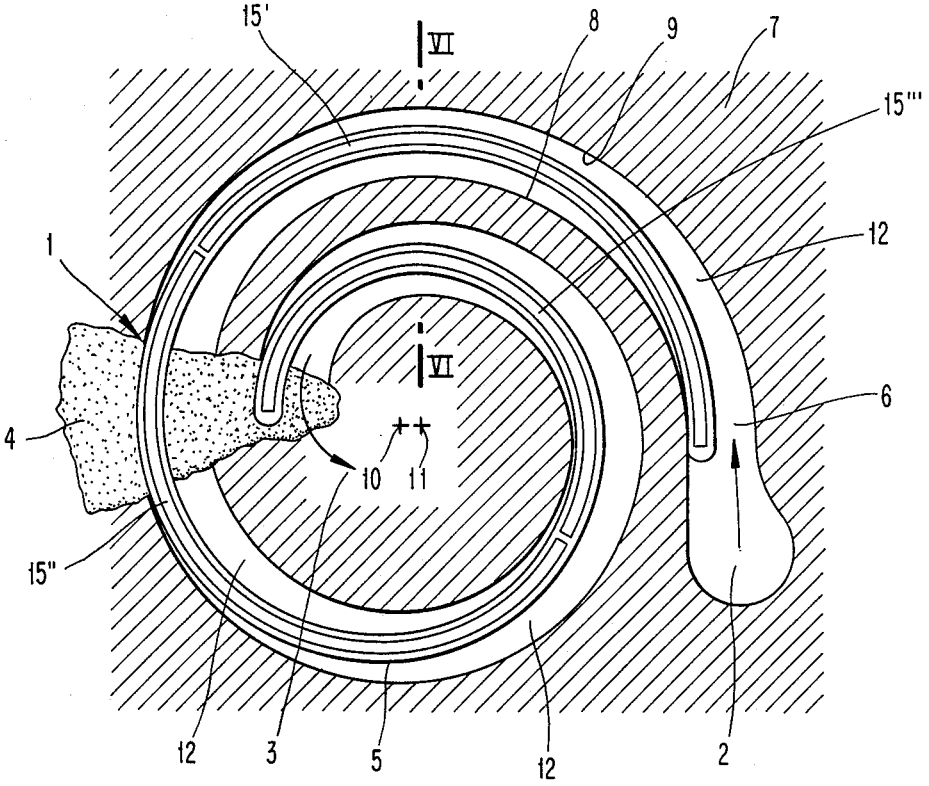
FIG. 5 shows a cross-section through the rotary-piston compressor in which the tube of FIG. 1 is made of three sectional pieces.
Figure 6:
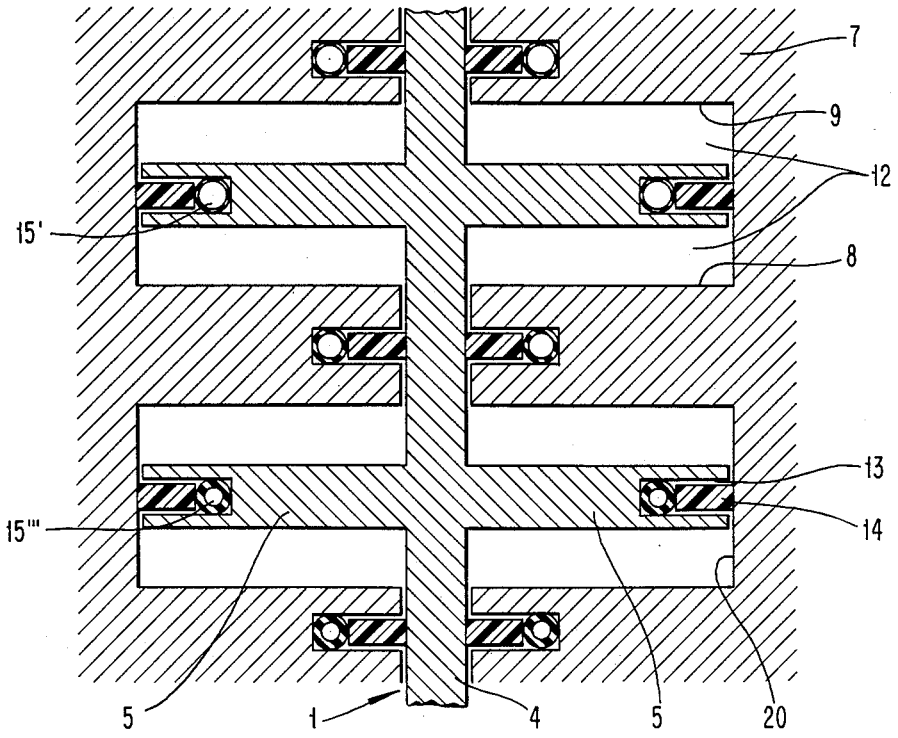
FIG. 6 shows a slightly enlarged partial sectional view through the plane VI—VI in FIG. 5 in which the pieces of the tube have different wall thicknesses.

As can be seen in FIG. 5 and 6, it is possible to use a multipiece tube 15', 15'', 15''', having a different wall thickness in each case, inside a spiral-shaped groove. A greater wall thickness than the inlet 2, where the sealing requirements are negligible, could be appropriate, for example, in the zone of the outlet 3 since higher working pressures prevail there in the delivery space 6 and a greater contact pressure of the sealing stri 14 against the side wall 16 is possibly desired.

Figure 4:
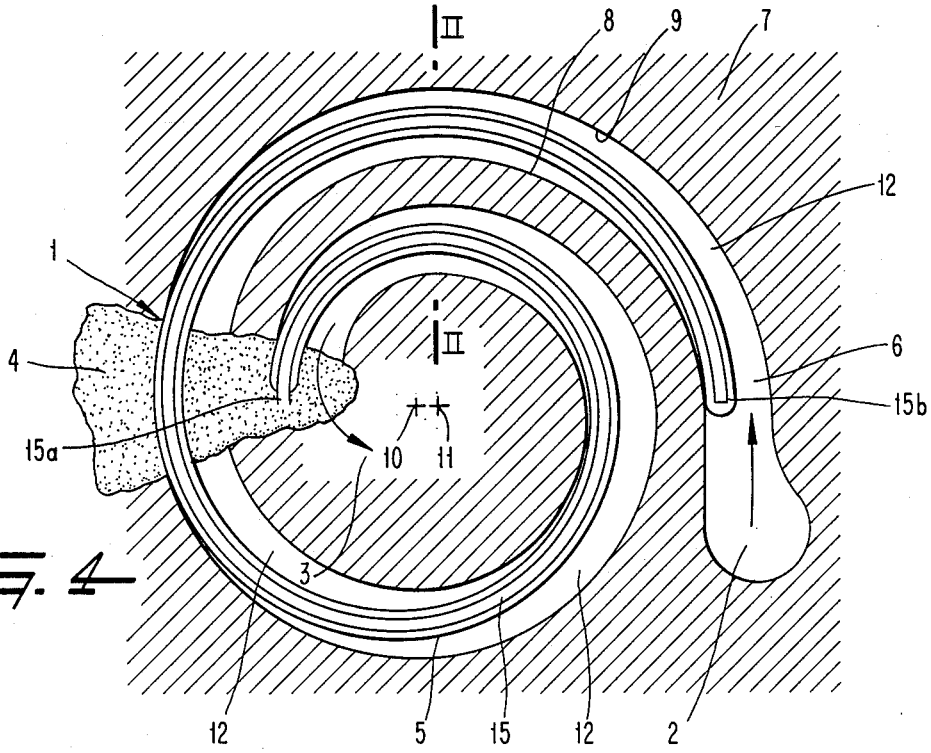
FIG. 4 shows a cross-section through the rotary-piston compressor in which the spring element has a open end pressure side and a closed end suction side.

In the embodiment of FIG. 4, the groove 13, on the pressure side, ie. on the outlet-side end of the spiral, has a run-out part which either passes beyond the area of the sealing strip or by which the sealing strip is shorter than the groove. The tube is open in this area 15a so that its interior is acted upon by the final pressure of the machine. In effect, uniform contact of the sealing strip over its entire length with the side face 20 is thereby achieved. But so that the pressurizing inside the tube does not lead to a steady loss of working medium at the other tube end, the inlet-side end **15*b*** there is closed.

It can likewise be recognized from FIG. 2 and 6 that not ony are the end faces of the displacement body 5 according to the invention sealed, but that the type of sealing can also be used at the adjacent surfaces of the disk 4 executing the circular motion and the stationary rib of the housing 7.

Obviously, numerous modifications and variations of the present invention are possible in the light of the above teachings. It is therefore to be understood that within the scope of the appended claims, the invention may be practiced otherwise than as specifically described herein.

What is claimed is:

1. A rotary-piston displacement machine for compressible media, comprising at least one deliver space which is defined by spiral-shaped peripheral walls, extending axially from a side wall, and leads from an inlet to an outlet, and includes a spiral-shaped displacement body which protrudes into the delivery space and is mounted with respect to the delivery space for executing a circling, torsion-free motion, the displacement body having a center offset eccentrically relative to a center of the peripheral walls in such a way that the displacement body always touches both an outer and inner wall defining the peripheral walls of the delivery space at at least one advancing contact point each, wherein end faces of the displacement body which adjoin the side wall are provided with a groove in which an elastic and slidable material sealing strip is inserted, and a spring element is arranged between a root of the groove and an underside of the sealing strip, the spring element being a tube of silicone rubber.

2. The rotary-piston displacement machine as claimed in claim 1, wherein the tube, extending over the entire length of the groove, has a closed end on a suction side of the displacement machine and an open end on a pressure side of the displacement machine.

3. A rotary-piston displacement machine as claimed in claim 1, wherein the tube is a plurality of sectional pieces having different wall thickness in which the outlet has a tube piece of greater wall thickness than said inlet due to increased working pressure of the compressible media.

* * * * *